United States Patent [19]

Patton

[11] 4,005,854

[45] Feb. 1, 1977

[54] FIGURE EIGHT FLUID FLOW PATTERN MIXING APPARATUS

[75] Inventor: David L. Patton, Rochester, N.Y.

[73] Assignee: Eastman Kodak Company, Rochester, N.Y.

[22] Filed: Aug. 1, 1975

[21] Appl. No.: 601,066

[52] U.S. Cl. ..... 259/4 R; 23/271 R; 259/95

[51] Int. Cl.[2] ..... B01F 5/02; B01F 5/10; B01F 5/12

[58] Field of Search ..... 259/4 R, 18, 95, DIG. 17; 134/200; 23/271 R

[56] References Cited

UNITED STATES PATENTS

| | | | |
|---|---|---|---|
| 1,768,957 | 7/1930 | Johnson | 23/271 |
| 2,262,940 | 11/1941 | Ish-Shalom | 259/4 R |
| 2,528,094 | 10/1950 | Walker | 259/4 R |
| 2,906,607 | 9/1959 | Jamison | 259/4 R |
| 3,661,364 | 5/1972 | Lage | 259/95 |
| 3,799,508 | 3/1974 | Arnold et al. | 259/4 R |
| 3,826,474 | 7/1974 | Pareja | 259/95 |

*Primary Examiner*—Richard E. Aegerter
*Assistant Examiner*—Richard R. Stearns
*Attorney, Agent, or Firm*—S. W. Gremban

[57] ABSTRACT

A mix tank of suitable shape is provided with a suitably located nozzle, for thoroughly mixing at least one material (solid or liquid) with a liquid supplied under pressure to the nozzle. The tank configuration and nozzle location combine to produce a generally figure eight fluid flow pattern marked by low levels of aeration and sudsing.

7 Claims, 5 Drawing Figures

FIGURE EIGHT FLUID FLOW PATTERN MIXING APPARATUS

BACKGROUND OF THE INVENTION

1. Field of the Invention

This invention relates to mixing apparatus, and more particularly to mixing apparatus for mixing at least one material with a liquid.

2. Description of the Prior Art

Generally, mixing apparatus described in the prior art fall into one of two classes — mixing apparatus which employ mechanical moving parts, such as motor driven rotors, propellors, etc., and mixing apparatus which do not have mechanical moving motor parts but instead rely on a forced fluid flow to accomplish mixing. Advantages of the latter type of mixing apparatus (flow energy mixing apparatus) over the former are well known. Mechanical mixing apparatus employ motors and other moving parts which are subject to wear and subsequent failure. Frequently, the chemicals being mixed, or vapors therefrom, are incompatible with the mechanical moving parts and thus directly induce mixer breakdown. Mechanical mixers also tend to generate substantial levels of noise which can be annoying if not disruptive to persons in the immediate vicinity of the mixer.

Flow-energy mixers are especially suited for mixing relatively small amounts (10 gallons or less) of miscible materials. The photographic field provides numerous examples wherein small amounts of miscible materials are mixed. For example, photographic processing solutions are often mixed in volumes from one to five gallons. In order for a flow-energy mixer to be of general utility in mixing a wide variety of materials, however, the mixer must possess certain properties — some of which are not readily compatible with each other, and some of which are not readily compatible with flow-energy mixing in general. The problems involved in designing a fow-energy mixer of general utility can be pointed out by considering the properties of flow-energy mixers disclosed in the prior art.

One of the earliest flow-energy mixers disclosed in the prior art is described in U.S. Pat. No. 2,528,094. Mixing is accomplished in a tank provided with baffles. Liquid under pressure is forced through a nozzle and into the tank, wherein the baffles coact to create a condition of high turbulence. As disclosed in the patent, this high turbulence may require flow rates in excess of that available from conventional water outlets such as house faucets, and thus additional pumping may be required in order to supply the energy consumed by the mixing unit. In many applications, the use of an extra pump is not desirable. For a flow-energy mixing apparatus suitable for mixing photographic chemicals, particularly mixing which is done by the amateur photographer in his home, it is preferable to have a mixing apparatus that operates effectively from conventional water outlets. In addition, baffles of the type described in the above patent are provided to produce high turbulence, but also tend to introduce "dead spots" wherein no mixing or a reduced level of mixing occurs.

U.S. Pat. No. 3,799,508 discloses a flow-energy mixing apparatus wherein a mixing compartment contains a nozzle mounted near the bottom of a mixing compartment and directs a liquid flow outwardly and downwardly to agitate the liquid in the compartment. The level of mixing may not be uniform throughout the mixing compartment, necessitating extended mixing periods in order to ensure uniform and thorough mixing of the compartment contents.

A device for continuous mixing of materials is described in U.S. Pat. No. 3,661,364. The materials to be mixed are pumped into a tank, near the bottom, and exit through an outlet pipe located near the top of the tank. Mixing is accomplished in a doughnut shaped fluid flow pattern. While using flow-energy to achieve mixing, the disclosed device employs a pump through which chemicals to be mixed are pumped and as a result, possesses the previously mentioned disadvantages of a mechanical mixer.

SUMMARY OF THE INVENTION

In the disclosed embodiment of the present invention, an apparatus is provided for mixing at least one material with a liquid. The mixing apparatus is of the flow-energy type and requires a relatively low liquid pressure for effective operation. The disclosed mixing apparatus produces a smooth fluid flow pattern which achieves uniform, thorough, and accurate mixing with no "dead spots", while producing only low levels of foaming and sudsing. The mixing apparatus is of simple design and is easily cleaned.

The disclosed mixing apparatus comprises a tank with suitably shaped surfaces and a nozzle suitably located. As liquid under pressure is supplied to the nozzle, the surfaces associated with the tank cooperate with the nozzle to cause the liquid discharged therefrom to flow in a generally figure eight fluid flow pattern. The material to be mixed with the liquid may be added to the tank by any suitable means. For example, it may be dumped into the tank by hand or added through a suitable piping system.

A further aspect of the present invention is that the generally figure eight fluid flow pattern has particular advantages for mixing two materials of the type which preferably should be mixed with a liquid before coming into contact. In accordance with this particular aspect of the present invention, means are provided for adding the two materials to the tank such that each of the materials is added to a separate lobe of the figure eight fluid flow pattern.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENT

Figure 1A:
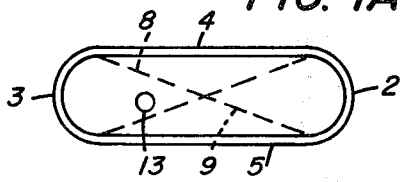
FIG. 1*a* is a horizontal sectional view at a reduced scale of the mixing apparatus shown in FIG. 1.
Figure 1:
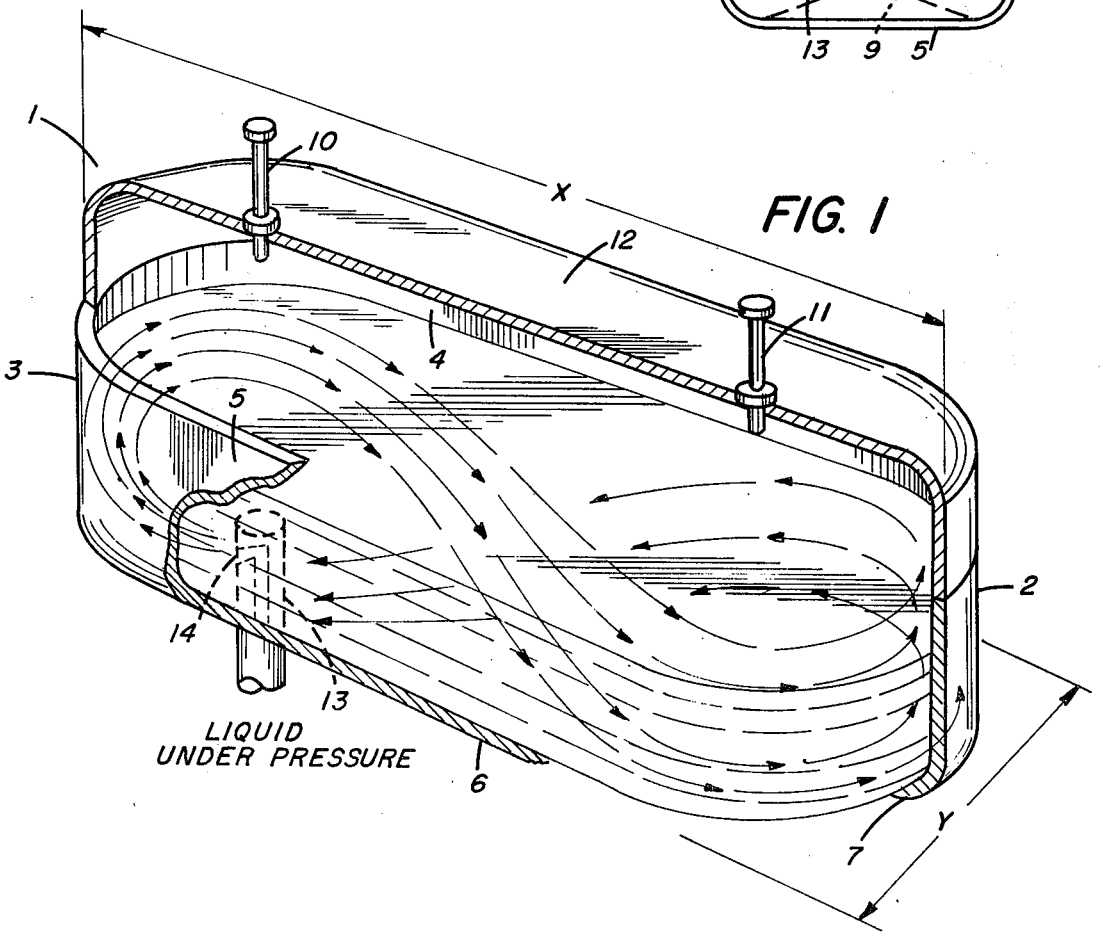
FIG. 1 is a perspective view with portions thereof broken away, of a preferred embodiment of the mixing apparatus showing the flow pattern of the tank contents.

Referring to the drawings, a mixing apparatus embodying the present invention is shown in FIGS. 1 and 1a, and generally designated 1. The mixing apparatus includes a tank, comprising two semicircular arcuate end wall sections 2 and 3, two planar side wall sections 4 and 5, a planar bottom section 6, and a curved section 7 joining the wall sections 2, 3, 4, and 5 to the bottom section 6. For purposes of liquid flow discussion hereinafter, the structure defines two imaginary intersecting geometric diagonal planes 8 and 9, extending between the ends of the arcuate end wall sections 2 and 3 as shown in FIG. 1a. Material to be mixed is gravity fed to the tank via a pair of inlet pipe 10 and 11 which are mounted in a top section 12.

A nozzle 13 having a tubular orifice 14 is mounted on the bottom section 6 and located near the arcuate end wall section 3 and the front planar side wall section 5. The nozzle 13 is coupled to a source of liquid under pressure, such as a house faucet, by suitable conduits (not shown). The nozzle 13 is so oriented as to direct the liquid discharge toward the bottom section 6 at an angle with respect to the plane of the bottom section 6 and towards a portion of the curved section 7 joining the arcuate end wall section 3 to the planar bottom section 6. The liquid discharge is thus directed toward the arcuate end wall section 3 generally along the diagonal plane 9. The curvature of the curved section 7 imparts a generally upward motion to the flow of the liquid discharge, while the arcuate end wall section 3 directs the flow around and back along the other diagonal plane 8 toward the opposing portion of the arcuate end wall section 2. The arcuate end wall section 2 directs the flow around and back toward the nozzle 13, the flow moving generally underneath the diagonal flow from the arcuate end wall section 3 to the arcuate end wall section 2 as illustrated in FIG. 1. This generally figure eight fluid flow pattern continues while materials to be mixed with the liquid are gravity fed through the inlet pipes 10 and 11.

The inlet pipes 10 and 11 supply each material to a separate lobe of the figure eight fluid flow pattern. One particular advantage of this inlet pipe arragement is that it provides for the use of two materials of the type which preferably should not be premixed. Various photographic chemicals are of this type. However, it will be apparent to those skilled in the art, that insofar as mixing is concerned, the materials may be added anywhere along the flow path, not necessarily in the lobes.

Figure 2:
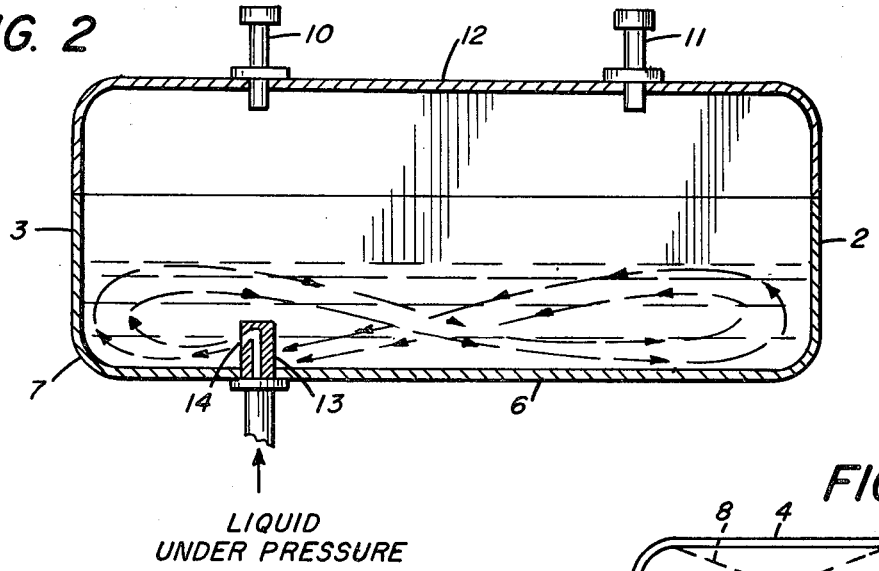
FIG. 2 is a side elevational view in section of the mixing apparatus shown in FIG. 1.

As shown in FIG. 2, the diagonal flow from the arcuate end wall section 3 to the arcuate end wall section 2 is generally above the diagonal flow from the arcuate end wall section 2 to the arcuate end wall section 3. It is also seen how the curved section 7 imparts a generally upwardly influence on the flow both at the arcuate end wall section 3 and the arcuate end wall section 2.

In order to produce optimum mixing action while maintaining low levels of aeration and sudsing, a general relationship exists among the tank size and shape, the size of the nozzle orifice 14, the viscosity of the liquid, and the pressure at which liquid is supplied to the nozzle 13. It will thus be apparent to those skilled in the art that the optimum tank size and shape will vary according to the particular mixing application involved. However, by way of example, it has been empirically determined that for a tank of the configuration shown in FIGS. 1 and 2, having a length measured along the X direction of 18 inches, and a width measured along the Y direction of 8 inches, suitable results are obtained when nozzle 13 has a tubular orifice 14 of a diameter between 1/32 and 5/32 of an inch, the liquid, having a viscosity between 0.02 and 0.20 poise, is supplied to the nozzle at a pressure between 7.5 and 50 pounds per square inch, and a miscible material of any viscosity is added to the tank through the inlet ports 10 and 11.

In the disclosed embodiment only one nozzle position has been described, but it should be apparent that the nozzle may alternatively be positioned at other locations along the generally figure eight fluid flow path with equivalent results. Also, in the disclosed embodiment the mixing tank has walls that act with the liquid discharged from the nozzle to produce a generally figure eight fluid flow pattern. It is apparent to those skilled in the art, that tanks of varied shapes can be provided with baffle arrangements to provide fluid deflecting surfaces of the type shown in FIG. 1 to thereby produce the generally figure eight fluid flow pattern. This baffle construction may be preferable in those cases where tanks of a particular shape, for example, rectangular tanks, are already available, as it may be less costly to manufacture appropriate baffles than to produce or purchase new tanks.

In the disclosed embodiment, the lobes of the figure eight fluid flow pattern are substantially equal. If desired, by altering the tank shape, nozzle position, liquid pressure, liquid viscosity, or a combination thereof, it is possible to produce figure eight fluid flow patterns of unequal lobe sizes. Unequal lobe sizes may be desirable if unequal quantities of two materials are to be mixed. The material of lesser amount may be added to the smaller lobe and the material of greater amount added to the larger lobe or visa versa. Also, in some applications it may be preferable to provide means (visual, electrical or mechanical) for indicating the level of the tank contents.

Figure 3:
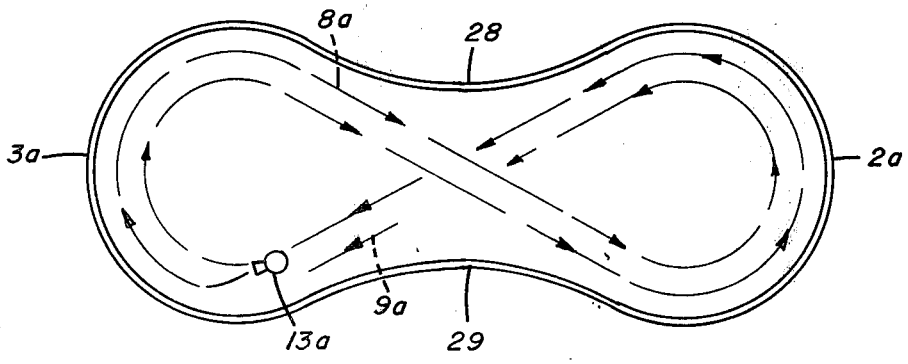
FIG. 3 is a top view of an alternate tank shape for mixing apparatus shown in FIG. 1.

A modification of the disclosed embodiment is shown in FIG. 3. wherein parts identical to those shown in FIGS. 1, 1*a*, and 2 have been given like reference numerals followed by the suffix (*a*). As an alternative to the planar side wall sections 4 and 5, a pair of inwardly curved side wall sections 28 and 29 are provided to produce a tank configuration more complemental to the figure eight fluid flow pattern.

Figure 4:
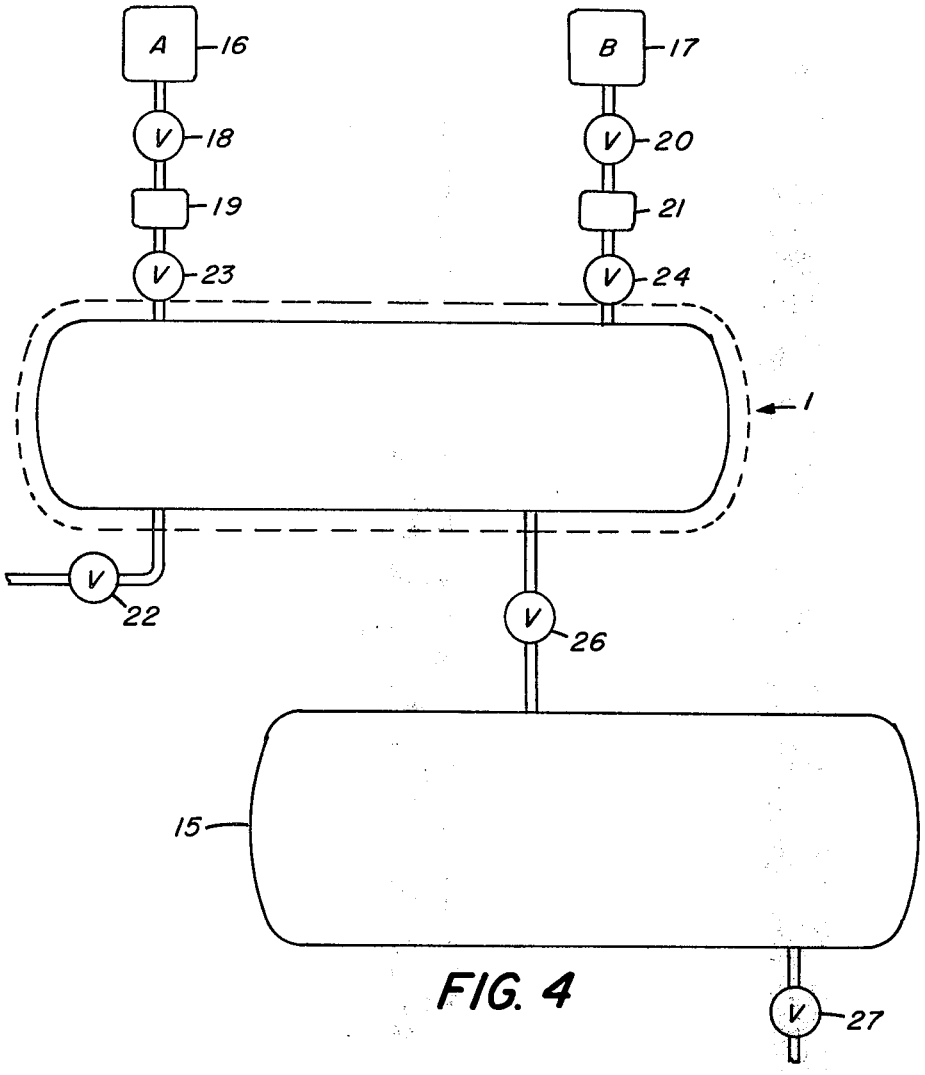
FIG. 4 is a schematic view illustrating one application of the disclosed embodiment of the present invention.

FIG. 4 illustrates one application employing the disclosed embodiment of the present invention. The application illustrated utilizes the mixing apparatus 1 to mix a two part photographic developer with water. In this application, mixed developing solution is supplied at a predetermined rate to a developing tank 15 for purposes of developer replenishment. More specifically, two parts of the photographic developer concentrates are stored in a part A storage tank 16 and a part B storage tank 17 respectively. A measured amount of part A is supplied through a valve 18 to a measuring tank 19. Similarly, a measured amount of part B is supplied through a valve 20 to a measuring tank 21. Water under pressure is then supplied to the disclosed mixing apparatus 1 by way of a valve 22, whereby as previously disclosed, a generally figure eight fluid flow pattern is obtained. Parts A and B of the developer are then supplied by way of valves 23 and 24 to the mixing tank of mixing apparatus 1, supplying each part of the developer to a separate lobe. As the mixing tank is filled to a prescribed level, the valve 22 is closed, thereby terminating the mixing of the two-part developer. A valve 26 supplies the mixed developer to a holding tank 15. Upon demand, a valve 27 supplies developer from the holding tank 15 to a processing or other apparatus (not shown).

The invention has been described in detail with particular reference to preferred embodiments thereof, but it, will be understood that variations and modifications can be effected within the spirit and scope of the invention.

We claim:

1. Apparatus for mixing at least one material with a liquid, comprising:

a tank for receiving the material to be mixed with the liquid, said tank including a generally planar bottom section and an adjacent curved section;

a nozzle positioned in said tank for discharging the liquid into said tank;

means for supplying the liquid under pressure to said nozzle; and said nozzle being oriented to direct the liquid discharged therefrom toward said bottom section of said tank at an angle with respect to said bottom section toward said curved section, the position of said nozzle and the shape of the tank cooperating to impart a generally figure eight fluid flow pattern to the material and the liquid in said tank for mixing the material and the liquid.

2. Apparatus as claimed in claim 1 further comprising means for adding the material to the liquid in at least one of the lobes of the generally figure eight fluid flow pattern.

3. An apparatus for mixing at least one material with a liquid, comprising:

a tank having two opposite arcuate end wall sections, two opposite side wall sections, a generally planar bottom section, and a curved section joining the wall sections to the bottom section;

a nozzle positioned in said tank;

means for supplying the liquid under pressure to said nozzle for discharge into said tank;

means for feeding into said tank the material to be mixed with the liquid; and said nozzle being oriented to direct the liquid discharged therefrom toward said bottom section of said tank at an angle with respect to the plane of said bottom section and toward said curved section, said nozzle and tank sections cooperating to impart a generally figure eight fluid flow pattern to the material and the liquid in said tank for mixing the material and the liquid.

4. An apparatus for mixing at least one material with a liquid, comprising:

a tank for receiving the material to be mixed with the liquid, said tank having two opposite arcuate end wall sections, two opposite side wall sections, a generally planar bottom section, and a curved section joining said wall sections to said bottom section;

a nozzle positioned in said tank;

means for supplying the liquid under pressure to said nozzle for discharge into said tank;

said nozzle being oriented to direct the liquid discharge therefrom toward said bottom section of said tank at an angle with respect to the plane of said bottom section and toward said curved section, said nozzle and tank sections cooperating to impart a generally figure eight fluid flow pattern having two spaced lobes, to the material and the liquid in said tank for mixing the material and the liquid; and means for adding material to the liquid in at least one of the lobes of the generally figure eight fluid flow pattern.

5. An apparatus for mixing at least one material with a liquid, comprising:

a tank having two opposite arcuate end wall sections, two opposite side wall sections, a generally planar bottom section, and a curved section joining the wall sections to the bottom section, said tank having a configuration defining two imaginary intersecting geometric diagonal planes extending between the ends of said arcuate end wall sections;

a nozzle positioned in said tank;

means for supplying the liquid under pressure to said nozzle for discharge into said tank;

means for feeding into said tank the material to be mixed with the liquid; and said nozzle positioned to direct the liquid toward said bottom section of said tank at an angle with respect to the plane of said bottom section and along one of the diagonal planes, around one of said arcuate end wall sections, back along the other of the diagonal planes and around the other of said arcuate end wall sections in a generally figure eight fluid flow pattern to mix the liquid and material.

6. An apparatus as claimed in claim 5 wherein said arcuate end wall sections are generally semicircular and said two side wall sections are generally planar.

7. An apparatus as claimed in claim 5 wherein said arcuate end wall sections are generally semicircular, and said side wall sections are inwardly curved and protrude generally towards the intersection of the geometric diagonal plane.

* * * * *